US009951782B2

(12) United States Patent
Kurihara et al.

(10) Patent No.: US 9,951,782 B2
(45) Date of Patent: Apr. 24, 2018

(54) CENTRIFUGAL FAN AND AIR-CONDITIONING APPARATUS INCLUDING THE SAME

(71) Applicant: Mitsubishi Electric Corporation, Tokyo (JP)

(72) Inventors: Makoto Kurihara, Tokyo (JP); Masahiko Takagi, Tokyo (JP); Takashi Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 429 days.

(21) Appl. No.: 14/413,488

(22) PCT Filed: Jul. 30, 2013

(86) PCT No.: PCT/JP2013/070638
§ 371 (c)(1),
(2) Date: Jan. 8, 2015

(87) PCT Pub. No.: WO2014/034359
PCT Pub. Date: Mar. 6, 2014

(65) Prior Publication Data

US 2015/0167674 A1 Jun. 18, 2015

(30) Foreign Application Priority Data

Aug. 29, 2012 (JP) ..... 2012-188752

(51) Int. Cl.
*F04D 17/10* (2006.01)
*F04D 29/30* (2006.01)
(Continued)

(52) U.S. Cl.
CPC ..... *F04D 17/10* (2013.01); *F04D 29/023* (2013.01); *F04D 29/281* (2013.01); *F04D 29/30* (2013.01);
(Continued)

(58) Field of Classification Search
CPC ..... F04D 17/10; F04D 29/023; F04D 29/281; F04D 29/30; F05D 2240/305; F05D 2250/291
See application file for complete search history.

(56) References Cited

U.S. PATENT DOCUMENTS 3,426,965 A 2/1969 Kulling
8,007,240 B2 * 8/2011 Sanagi ..... F04D 29/282 29/889.4
(Continued)

FOREIGN PATENT DOCUMENTS

CN 203463314 U 3/2014
EP 1 878 923 A2 1/2008
(Continued)

OTHER PUBLICATIONS

International Search Report of the International Searching Authority dated Oct. 22, 2013 for the corresponding international application No. PCT/JP2013/070638 (and English translation).
(Continued)

*Primary Examiner* — Kenneth Bomberg
*Assistant Examiner* — Hoon Choi
(74) *Attorney, Agent, or Firm* — Posz Law Group, PLC

(57) ABSTRACT

A centrifugal fan includes a main plate that is fixed to the rotational shaft of a fan motor and driven by the fan motor, a shroud having an air inlet, and a plurality of blades disposed between the main plate and the shroud. Each blade includes a main blade set on its suction surface side and a blade cover set on its pressure surface side. The main blade is joined to the main plate and the shroud. The blade cover is joined to the main blade, and is biased toward the main blade under the air pressure during rotation. Thus, the joint force between the main blade and the blade cover is enhanced, thereby enhancing the strength of joint of engagement portions of the blade and reducing abnormal noise
(Continued)

generated due to the presence of one or a plurality of gaps formed between the engagement portions.

17 Claims, 3 Drawing Sheets

(51) Int. Cl.
*F04D 29/02* (2006.01)
*F04D 29/28* (2006.01)

(52) U.S. Cl.
CPC .. *F05D 2230/232* (2013.01); *F05D 2240/305* (2013.01); *F05D 2250/291* (2013.01)

(56) References Cited

U.S. PATENT DOCUMENTS

| | | | | |
|---|---|---|---|---|
| 8,732,948 | B2 * | 5/2014 | Nishino | F04D 29/023 156/272.8 |
| 2007/0098556 | A1 | 5/2007 | Sanagi et al. | |
| 2009/0252612 | A1 * | 10/2009 | Ahmad | B23P 15/04 416/241 A |
| 2011/0023526 | A1 * | 2/2011 | Ohyama | F04D 29/281 62/426 |

FOREIGN PATENT DOCUMENTS

| | | | |
|---|---|---|---|
| JP | S64-41696 | U | 3/1989 |
| JP | H10-122196 | A | 5/1998 |
| JP | 4432474 | B2 | 6/2005 |
| JP | 2008-2379 | A | 1/2008 |
| JP | 2009-250112 | A | 10/2009 |

OTHER PUBLICATIONS

Chinese Office Action dated Jul. 3, 2015 in the corresponding CN application No. 201310380265.4 (English translation attached).
Office Action dated May 7, 2015 issued in corresponding JP patent application No. 2012-188752 (and English translation).
Office Action dated Nov. 17, 2015 in the corresponding JP application No. 2012-188752 (with English translation).
Extended European Search Report dated Mar. 10, 2016 issued in corresponding EP patent application No. 13832316.7.
Office Action dated Sep. 1, 2015 in the corresponding AU application No. 2013310396.

* cited by examiner

CENTRIFUGAL FAN AND AIR-CONDITIONING APPARATUS INCLUDING THE SAME

CROSS REFERENCE TO RELATED APPLICATION

This application is a U.S. national stage application of International Application No. PCT/JP2013/070638 filed on Jul. 30, 2013 and is based on Japanese Patent Application No. 2012-188752 filed on Aug. 29, 2012, the disclosures of which are incorporated by reference.

TECHNICAL FIELD

The present invention relates to a centrifugal fan that draws a gas by suction in the axis of rotation direction and blows the gas in the direction in which a line intersecting with the axis of rotation of a rotational shaft runs, and an air-conditioning apparatus including the centrifugal fan.

BACKGROUND ART

The mainstream centrifugal fans employ non-twisted two-dimensional blades provided between a main plate and a shroud. Thus, the main plate and the blades are typically integrated. However, to further reduce noise and power consumption, twisted three-dimensional blades that are provided between the main plate and the shroud have become necessary.

A three-dimensional blade can be formed in a complex shape with an increased flexibility in resin molding by using a plurality of parts for the blade. In addition, the blade is formed to have a hollow internal structure so as to achieve a lightweight configuration (see, for example, Patent Literature 1).

In another example, in an engagement portion in which a plurality of parts constituting a three-dimensional blade of an axial flow fan engage with each other, an engagement line formed between these parts by their engagement bends in a zigzag pattern and bent portions are joined to each other by local irradiation with an ultrasonic wave in order to increase the number of joints, and thereby enhance the strength of joint (see, for example, Patent Literature 2).

CITATION LIST

Patent Literature

Patent Literature 1: Japanese Patent No. 4432474 (FIGS. 5 and 6)

Patent Literature 2: Japanese Unexamined Patent Application Publication No. 10-122196 (FIG. 1)

SUMMARY OF INVENTION

Technical Problem

As described above, a fan equipped with three-dimensional blades employs blades each formed by a plurality of parts in order to obtain a complex blade shape. Accordingly, the blade shape becomes less constrained by the mold structure, and each blade can be formed to have a hollow internal structure so as to achieve a lightweight configuration.

The conventional centrifugal fan includes blades each having its pressure surface formed by a main blade fixed to a main plate and a shroud, and its suction surface formed by a blade cover joined to the main blade. In the centrifugal fan, an airstream flowing on the blade surface during rotation generates an air pressure difference between the pressure surface and the suction surface. In this case, the main blade forming the pressure surface is biased toward the blade cover under the air pressure during rotation. However, since, as described above, the main blade is fixed to the main plate and the shroud and the blade cover is attached to the main blade, the biasing force produced by the air pressure does not enhance the joint force between the main blade and the blade cover, and consequently is absorbed in the main plate and the shroud. Thus, the main blade and the blade cover have a low strength of joint and a low material strength, and one or a plurality of gaps are easily formed between engagement portions. As a result, abnormal noise is likely to be produced disadvantageously.

The present invention has been made to solve the aforementioned problem, and has as its object to enhance the strength of joint between engagement portions of blades so as to reduce abnormal noise generated due to the presence of one or a plurality of gaps formed between the engagement portions.

Solution to Problem

A centrifugal fan according to the present invention includes a main plate that is fixed to a rotational shaft of a fan motor and driven by the fan motor, a shroud having an air inlet, and a plurality of blades disposed between the main plate and the shroud. The centrifugal fan draws a gas by suction in the axis of rotation direction and blows the gas in the direction in which a line intersecting with the axis of rotation of the rotational shaft runs. Each of the blades includes a main blade set on its suction surface side and a blade cover set on its pressure surface side. The main blade is joined to the main plate and the shroud. The blade cover is joined to the main blade.

An air-conditioning apparatus according to the present invention includes the centrifugal fan.

Advantageous Effects of Invention

In the centrifugal fan of the present invention, an airstream flowing on the blade surface during rotation generates an air pressure difference between the blade cover and the main blade. Thus, during rotation, the blade cover is biased toward the main blade under the air pressure. At this time, since the main blade is joined to the main plate and the shroud, the biasing force generated by the air pressure acts to enhance the joint force between the main blade and the blade cover. Accordingly, the formation of one or a plurality of gaps between engagement portions of the main blade and the blade cover can be prevented, and their strength of joint and material strength are enhanced. As a result, one or a plurality of gaps are hardly formed between the engagement portions, so that generation of abnormal noise can be suppressed.

In addition, an air-conditioning apparatus which uses the centrifugal fan and shows enhanced strength and reduced noise and energy consumption can be provided.

DESCRIPTION OF EMBODIMENTS

Embodiment 1

Figure 1:
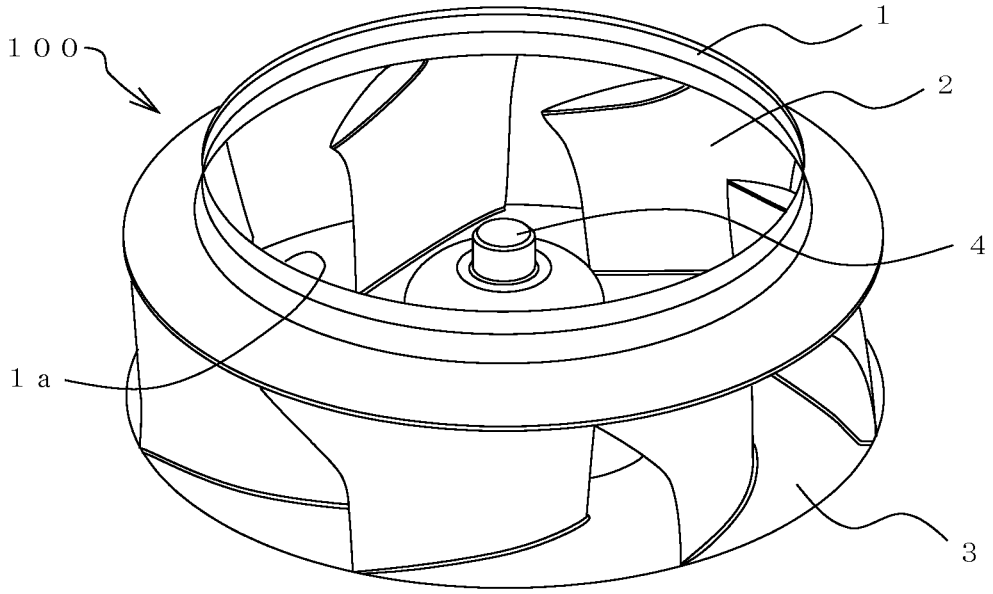
FIG. 1 is a perspective view illustrating an exemplary configuration of a centrifugal fan according to Embodiment 1.
Figure 2:
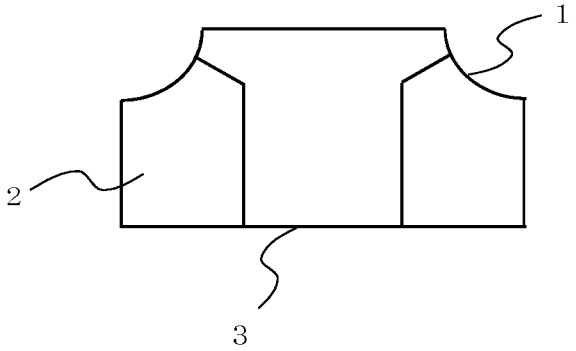
FIG. 2 is a cross-sectional view schematically illustrating the configuration of the centrifugal fan of Embodiment 1.

FIG. 1 is a perspective view illustrating an exemplary configuration of a centrifugal fan according to Embodiment 1. FIG. 2 is a cross-sectional view schematically illustrating the configuration of the centrifugal fan of Embodiment 1.

As illustrated in FIGS. 1 and 2, in the centrifugal fan 100 of Embodiment 1, a plurality of blades 2 are provided between a shroud 1 with an air inlet 1*a* and a main plate 3, and a boss 4 serving as a rotational shaft is attached at the center of the main plate 3. To reduce noise and power consumption, the blades 2 have a twisted three-dimensional shape at the position between the shroud 1 and the main plate 3.

Figure 3:
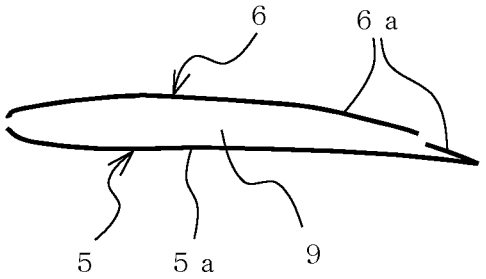
FIG. 3 is a cross-sectional view illustrating an exemplary configuration of a blade of the centrifugal fan of Embodiment 1 when viewed from the side.
Figure 4:
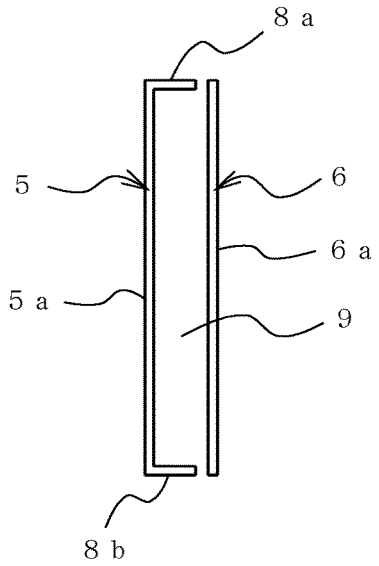
FIG. 4 is a cross-sectional view illustrating the configuration of the blade of the centrifugal fan of Embodiment 1 when viewed from the front.

FIG. 3 is a cross-sectional view illustrating an exemplary configuration of each blade of the centrifugal fan of Embodiment 1 when viewed from the side. FIG. 4 is a cross-sectional view illustrating the configuration of the blade of the centrifugal fan of Embodiment 1 when viewed from the front.

As illustrated in FIGS. 3 and 4, each blade 2 has a plurality of parts including a main blade 5 forming the whole of a suction surface 5*a* and a part of a pressure surface 6*a*, and a blade cover 6 forming the remaining part of the pressure surface 6*a*. The main blade 5 has a side surface 8*a* that is in contact with the shroud 1, and a side surface 8*b* that is in contact with the main plate 3. After the main blade 5 and the blade cover 6 are assembled together, the assembled member is placed between the shroud 1 and the main plate 3, and the side surfaces 8*a* and 8*b* are joined to the shroud 1 and the main plate 3, respectively, by welding. That is, the main blade 5 is joined to the shroud 1 and the main plate 3 by welding, and the blade cover 6 is joined to the main blade 5. These joining processes may be performed by, for example, welding or screwing. The main blade 5 and the blade cover 6 are opposed to each other, and a hollow portion 9 is formed between the main blade 5 and the blade cover 6.

The centrifugal fan 100 of Embodiment 1 is thus configured to allow an airstream flowing on the surfaces of the blades 2 during rotation to generate an air pressure difference between the pressure surface 6*a* and the suction surface 5*a*. Accordingly, during rotation, the blade cover 6 is biased toward the main blade 5 under the air pressure. At this time, since the main blade 5 is joined and fixed to the main plate 3 and the shroud 1, the biasing force generated by the air pressure acts such that the blade cover 6 is pressed against the main blade 5, thereby enhancing the joint force between the main blade 5 and the blade cover 6. This configuration can prevent the formation of one or a plurality of gaps between engagement portions of the main blade 5 and the blade cover 6, and enhance their strength of joint and material strength so that one or a plurality of gaps are hardly formed between the engagement portions. As a result, generation of abnormal noise can be suppressed.

In addition, the main blade 5 forming the entire suction surface 5*a* and a part of the pressure surface 6*a* is fixed to the main plate 3 and the shroud 1, and the blade cover 6, which is lighter in weight than the main blade 5, forms the remaining part of the pressure surface 6*a* so that the air pressure difference generated during rotation is used to press the lightweight blade cover 6 against the main blade 5. As a result, the strength of joint between the main blade 5 and the blade cover 6 can further be increased.

Furthermore, the main blade 5, which is higher in mass but has a centrifugal force greater than the blade cover 6, is located on the side of the center of rotation (i.e., on the suction surface side), and the blade cover 6, which is relatively light in weight and has a small centrifugal force, is located on the outer side (i.e., on the pressure surface side). Thus, the difference in centrifugal force is used to apply an outward force (toward the blade cover) to the main blade 5, and an inward biasing force (toward the main blade) that is generated by the air pressure and acts on the blade cover 6, which is relatively light in weight and has a small centrifugal force. As a result, the strength of joint between the main blade 5 and the blade cover 6 can further be enhanced.

Accordingly, it is possible to prevent the formation of one or a plurality of gaps between the engagement portions of the main blade 5 and the blade cover 6, so that generation of abnormal noise can further be suppressed.

Since the main blade 5 and the blade cover 6 are opposed to each other, and the hollow portion 9 is formed between the main blade 5 and the blade cover 6, the blade 2 has a hollow internal structure so as to achieve a lightweight configuration.

Embodiment 2

Figure 5:
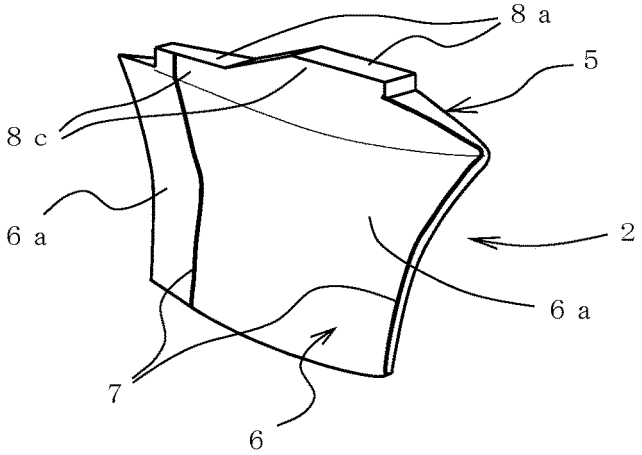
FIG. 5 is a perspective view illustrating an exemplary configuration of a blade of a centrifugal fan according to Embodiment 2.

FIG. 5 is a perspective view illustrating an exemplary configuration of a blade of a centrifugal fan according to Embodiment 2. The same reference numerals denote components having the same functions as those in Embodiment 1.

As illustrated in FIG. 5, in the centrifugal fan of Embodiment 2, a blade 2 and a shroud 1 have a projection and a groove which fit together and serve as their joint portion. In Embodiment 2, a stepped projection 8*c* is formed on a side surface 8*a* that is in contact with the shroud 1 of the blade 2, and a groove (not shown) is formed in the shroud 1 opposed to the shroud 1 and engages with the projection 8*c*. Lines 7 formed in the front and rear portions of the blade 2 indicate the boundaries between engagement portions of a main blade 5 and a blade cover 6. Configurations other than the above-mentioned configuration are the same as those in Embodiment 1.

In the centrifugal fan of Embodiment 2, in addition to advantages similar to those of Embodiment 1 described above, the main plate 3, the main blade 5, and the shroud 1 are easily positioned and assembled with high accuracy, and the strength of the structure formed by assembling the main plate 3, the main blade 5, and the shroud 1 together can be enhanced.

Embodiment 3

Figure 6:
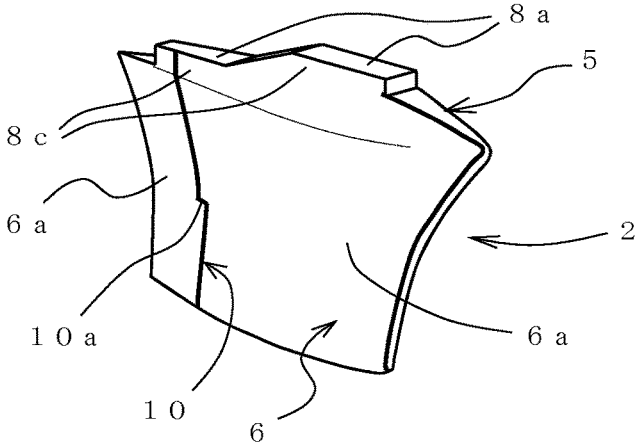
FIG. 6 is a perspective view illustrating an exemplary configuration of a blade of a centrifugal fan according to Embodiment 3.

FIG. 6 is a perspective view illustrating an exemplary configuration of a blade of a centrifugal fan according to Embodiment 3. In FIG. 6, the same reference numerals denote components having the same functions as those in Embodiments 1 and 2.

As illustrated in FIG. 6, in the centrifugal fan of Embodiment 3, the main blade 5 and the blade cover 6 share a mortise-tenon engagement portion 10 having a projection and a groove that fit together so that the main blade 5 and the blade cover 6 engage with each other. In Embodiment 3, a crank-shaped portion 10*a* is provided at one intermediate position in an engagement line formed between a main blade 5 and a blade cover 6 by their engagement in the rear portion of a blade 2. The mortise-tenon engagement portion 10 may be provided in the leading edge of the blade 2, or in each of the leading edge and the rear portion of the blade 2. Configurations other than the above-mentioned configuration are the same as those in Embodiments 1 and 2.

In the centrifugal fan of Embodiment 3, in addition to advantages similar to those of Embodiments 1 and 2 described above, the mortise-tenon engagement portion 10 including the crank-shaped portion 10*a* increases the strength of joint and the resistance to torsion, thereby advantageously preventing the formation of one or a plurality of gaps in the joint portion.

Embodiment 4

Figure 7:
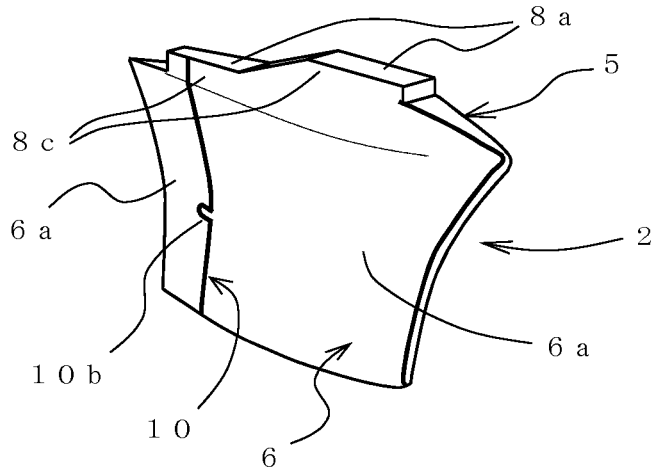
FIG. 7 is a perspective view illustrating an exemplary configuration of a blade of a centrifugal fan according to Embodiment 4.

FIG. 7 is a perspective view illustrating an exemplary configuration of a blade of a centrifugal fan according to Embodiment 4. The same reference numerals denote components having the same functions as those in Embodiments 1 to 3.

As illustrated in FIG. 7, in the centrifugal fan of Embodiment 4 as well, a main blade 5 and a blade cover 6 share a mortise-tenon engagement portion 10 having a projection and a groove that fit together so that the main blade 5 and the blade cover 6 engage with each other. In Embodiment 4, a projection-and-groove portion 10*b* is provided at one intermediate position in an engagement line formed between the main blade 5 and the blade cover 6 by their engagement in the rear portion of a blade 2. The mortise-tenon engagement portion 10 may be provided in the leading edge of the blade 2, or in each of the leading edge and the rear portion of the blade 2. Configurations other than the above-mentioned configuration are the same as those in Embodiments 1 to 3.

In the centrifugal fan of Embodiment 4, in addition to advantages similar to those of Embodiments 1 to 3 described above, the mortise-tenon engagement portion 10 including the projection-and-groove portion 10*b* further includes the strength of joint and the resistance to torsion, thereby advantageously preventing the formation of one or a plurality of gaps in the joint portion.

Embodiment 5

Figure 8:
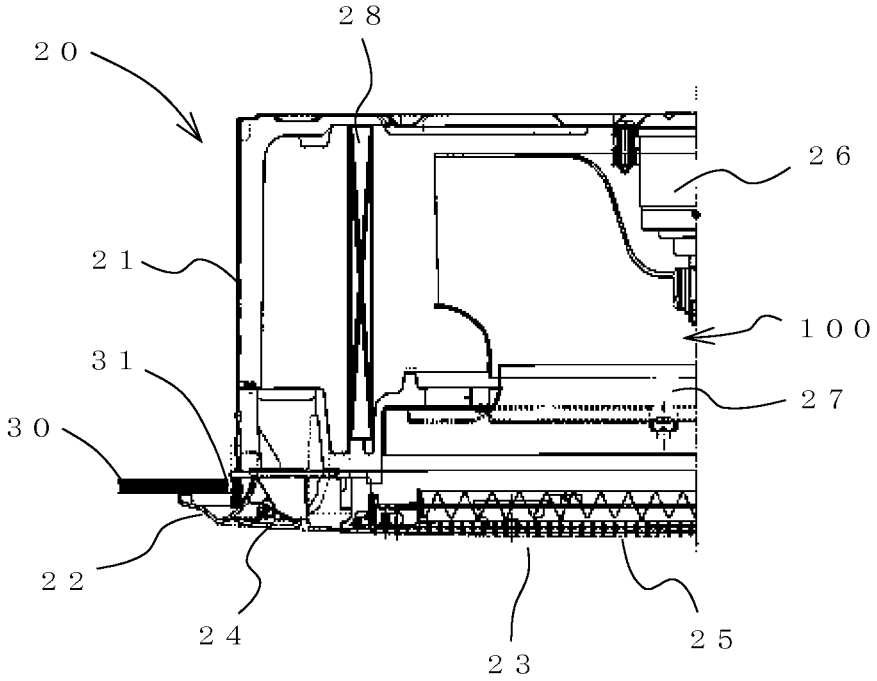
FIG. 8 is a partial cross-sectional view illustrating an indoor unit in an example of application to an air-conditioning apparatus according to Embodiment 5.

FIG. 8 is a partial cross-sectional view illustrating an example of application to an air-conditioning apparatus according to Embodiment 5, that is, a ceiling concealed indoor unit. In FIG. 8, the same reference numerals denote components having the same functions as those in Embodiment 1. The following description will be given with reference to FIG. 1.

Reference numeral 20 denotes a ceiling concealed indoor unit which is embedded in the surface of a ceiling 30 under the roof. The indoor unit 20 has a body shell 21 provided with an opening which is defined in its lower surface and is open to the room beneath the ceiling 30 through an opening 31 defined in the ceiling 30. A decorative panel 22 having an air inlet 23 and an air outlet 24 extends across the distance from the opening in the lower surface of the body shell 21 to the periphery defining the opening 31 of the ceiling 30. A filter 25 is disposed downstream of the air inlet 23.

A fan motor 26 is attached to the top plate of the body shell 21. A boss 4 of a centrifugal fan 100 having a shroud 1 with an air inlet 1*a* set on the side of the air inlet 23 of the decorative panel 22 is fixed to the output shaft of the fan motor 26. A bell mouth 27 is disposed between the air inlet 23 of the decorative panel 22 and the air inlet 1*a* of the shroud 1 of the centrifugal fan 100. A heat exchanger 28 is provided downstream of the centrifugal fan 100 in an air passage extending from the air inlet 23 to the air outlet 24, and surrounds the centrifugal fan 100.

In an air-conditioning apparatus including the above-described ceiling concealed indoor unit 20, when its operation starts, the fan motor 26 is rotated, and the centrifugal fan 100 fixed to the fan motor 26 rotates. With the rotation of the centrifugal fan 100, the indoor air is drawn by suction from the air inlet 23 and cleaned by the filter 25. The clean air flows from the bell mouth 27 into the centrifugal fan 100, and flows out of the centrifugal fan 100 through the gaps between adjacent blades 2 to the environment. The air that has flowed out of the centrifugal fan 100 passes through the heat exchanger 28, turns into cold or hot conditioned air in the heat exchanger 28, and is blown into the room through the air outlet 24.

In Embodiment 5, the centrifugal fan 100 of one of Embodiments 1 to 4 is used, and thus, an air-conditioning apparatus showing a high strength, low noise, and low energy consumption can be obtained.

In the foregoing description, the centrifugal fan of the present invention is used for the indoor unit (see FIG. 8) of the air-conditioning apparatus. Alternatively, the centrifugal fan may be used for an indoor unit with another configuration. The centrifugal fan of the present invention is also applicable to an outdoor unit of an air-conditioning apparatus or an air cleaner.

REFERENCE SIGNS LIST

1 shroud 1*a* air inlet 2 blade 3 main plate 4 boss 5 main blade 5*a* suction surface 6 blade cover 6*a* pressure surface 7 line 8*a* shroud-side side surface 8*b* main-blade-side side surface 8*c* stepped projection 9 hollow portion 10 engagement portion 10*a* crank-shaped portion 10*b* projection-and-groove portion 20 indoor unit 21 body shell 22 decorative panel 23 air inlet 24 air outlet 25 filter 26 fan motor 27 bell mouth 28 heat exchanger 30 ceiling 31 opening 100 centrifugal fan

The invention claimed is:

1. A centrifugal fan comprising:

a main plate that is attachable to a rotational shaft of a fan motor and driven by the fan motor;

a shroud having an air inlet; and a plurality of blades disposed between the main plate and the shroud, wherein the centrifugal fan draws a gas by suction in an axis of rotation direction and blows the gas in a direction intersecting the axis of rotation direction, each of the blades includes a main blade that is set on a suction surface side thereof and a blade cover that is set on a pressure surface side thereof, the main blade includes a main plate side-surface welded to the main plate and a shroud side-surface welded to the shroud, and the blade cover is joined to the main plate side-surface and the shroud side-surface of the main blade.

2. The centrifugal fan of claim 1, wherein the main blade and the blade cover are opposed to each other, and a hollow portion is provided between the main blade and the blade cover.

3. The centrifugal fan of claim 1, wherein the main blade and the blade cover share a mortise-tenon engagement portion having a projection and a groove that fit together so that the main blade and the blade cover engage with each other.

4. The centrifugal fan of claim 3, wherein the mortise-tenon engagement portion is provided in at least one of a leading edge and a rear portion of each of the blades.

5. The centrifugal fan of claim 3, wherein the mortise-tenon engagement portion has a crank-shaped portion at one intermediate position in an engagement line formed between the main blade and the blade cover by engagement of the main blade and the blade cover.

6. The centrifugal fan of claim 3, wherein the mortise-tenon engagement portion has a projection-and-groove portion at one intermediate position in an engagement line formed between the main blade and the blade cover by engagement of the main blade and the blade cover.

7. The centrifugal fan of claim 1, wherein at least one of a joint portion between the main blade and the main plate, and a joint portion between the main blade and the shroud has a projection and a groove that engage with each other.

8. The centrifugal fan of claim 1, wherein the blades each including the main blade and the blade cover have a twisted three-dimensional blade shape at a position between the main plate and the shroud.

9. The centrifugal fan of claim 1, wherein the blade cover of each of the blades is attached to only the main blade without being directly attached to main plate and the shroud.

10. The centrifugal fan of claim 1, wherein the blade cover of each of the blades is attached to the main blade to bias toward the main blade during rotation to reinforce an engagement between the blade cover and the main blade of each of the blades under air pressure during rotation.

11. The centrifugal fan of claim 1, wherein the blade cover is lighter than the main blade of each of the blades to permit the blade cover to press against the main blade under pressure during rotation to reinforce the engagement between the blade cover and the main blade.

12. The centrifugal fan of claim 1, wherein the main blade occupies a larger proportion of each of the blades than the blade cover of each of the blades, the main blade includes one or more side surfaces, and the blade cover mates with the main blade.

13. An air-conditioning apparatus comprising:

a centrifugal fan, the centrifugal fan comprising:

a main plate that is attachable to a rotational shaft of a fan motor and driven by the fan motor;

a shroud having an air inlet; and a plurality of blades disposed between the main plate and the shroud, wherein the centrifugal fan draws a gas by suction in an axis of rotation direction and blows the gas in a direction intersecting the axis of rotation direction, each of the blades includes a main blade that is set on a suction surface side thereof and a blade cover that is set on a pressure surface side thereof, the main blade includes a main plate side-surface welded to the main plate and a shroud side-surface welded to the shroud, and the blade cover is joined to the main plate side-surface and the shroud side-surface of the main blade.

14. The air-conditioning apparatus of claim 13, wherein the blade cover of each of the blades is attached to only the main blade without being directly attached to main plate and the shroud.

15. The air-conditioning apparatus of claim 13, wherein the blade cover of each of the blades is attached to the main blade to bias toward the main blade during rotation to reinforce an engagement between the blade cover and the main blade of each of the blades under air pressure during rotation.

16. The air-conditioning apparatus of claim 13, wherein the blade cover is lighter than the main blade of each of the blades to permit the blade cover to press against the main blade under pressure during rotation to reinforce the engagement between the blade cover and the main blade.

17. The air-conditioning apparatus of claim 13, wherein the main blade occupies a larger proportion of each of the blades than the blade cover of each of the blades, the main blade includes one or more side surfaces, and the blade cover mates with the main blade.

* * * * *